US008650818B1

(12) United States Patent
Smith

(10) Patent No.: US 8,650,818 B1
(45) Date of Patent: Feb. 18, 2014

(54) MOUNTING APPARATUS FOR DOOR JAMBS AND WINDOW FRAMES

(76) Inventor: Doug Smith, Fair Oaks, CA (US)

( * ) Notice: Subject to any disclaimer, the term of this patent is extended or adjusted under 35 U.S.C. 154(b) by 0 days.

(21) Appl. No.: 13/523,698

(22) Filed: Jun. 14, 2012

Related U.S. Application Data

(60) Provisional application No. 61/520,931, filed on Jun. 17, 2011.

(51) Int. Cl.
*E06B 1/04* (2006.01)

(52) U.S. Cl.
USPC ..... 52/211

(58) Field of Classification Search
USPC ..... 52/211, 212, 204.1, 210, 204.5, 208, 52/204.53, 204.54
See application file for complete search history.

(56) References Cited

U.S. PATENT DOCUMENTS

| | | | | | |
|---|---|---|---|---|---|
| 899,259 | A * | 9/1908 | Ohnstrand | 52/212 |
| 2,582,468 | A | 1/1952 | Sylvan | |
| 3,440,783 | A | 4/1969 | Hughes | |
| 3,457,686 | A | 7/1969 | Henson | |
| 3,614,846 | A | 10/1971 | Donnelly et al. | |
| 4,014,146 | A | 3/1977 | DiMascio et al. | |
| 4,281,481 | A | 8/1981 | Wendt | |
| 4,443,984 | A * | 4/1984 | Rasmussen | 52/213 |
| 4,674,248 | A * | 6/1987 | Hall | 52/212 |
| 5,210,986 | A | 5/1993 | Hagemeyer et al. | |
| 5,347,780 | A | 9/1994 | Richards et al. | |
| 5,584,150 | A * | 12/1996 | Newman | 52/204.2 |
| 5,619,823 | A * | 4/1997 | Ruff et al. | 49/504 |
| 5,722,207 | A | 3/1998 | Anderson et al. | |
| 6,148,883 | A * | 11/2000 | Wilson | 144/344 |
| 6,170,210 | B1 * | 1/2001 | Marts | 52/232 |
| 6,253,507 | B1 | 7/2001 | Martino | |
| 6,293,061 | B1 | 9/2001 | Horak, Jr. | |
| 6,560,944 | B1 * | 5/2003 | Wilson | 52/717.01 |
| 6,588,159 | B1 | 7/2003 | Cotton, Jr. | |
| 7,487,591 | B2 | 2/2009 | Harkins et al. | |
| 7,621,083 | B2 * | 11/2009 | Smith | 52/212 |
| 7,654,046 | B2 | 2/2010 | Ellingson | |
| 7,716,886 | B2 | 5/2010 | Gordon | |
| 7,882,662 | B2 | 2/2011 | Root et al. | |
| 7,921,603 | B2 | 4/2011 | Darnell | |
| 8,181,404 | B2 * | 5/2012 | Klein | 52/232 |
| 2006/0048466 | A1 * | 3/2006 | Darnell | 52/204.1 |
| 2009/0205271 | A1 * | 8/2009 | Fortin et al. | 52/204.71 |
| 2009/0241465 | A1 | 10/2009 | Majors | |
| 2010/0115864 | A1 | 5/2010 | De La Fontaine et al. | |

* cited by examiner

*Primary Examiner* — Mark Wendell
*Assistant Examiner* — Keith Minter
(74) *Attorney, Agent, or Firm* — Theodore J. Bielen, Jr.

(57) ABSTRACT

A mounting apparatus for door jambs and window frames utilizing a pair of angled legs attached to and extends along the entire length of an elongated element of the jamb or frame opposite the door or window opening, respectively. The angled legs may be moved inwardly or outwardly along the backside of the door jamb or window frame to accommodate the installation of drywall or filler compound. The angled legs may achieve a fire resistant status in combination with a metal stud found in an adjacent wall.

11 Claims, 3 Drawing Sheets

MOUNTING APPARATUS FOR DOOR JAMBS AND WINDOW FRAMES

CROSS REFERENCES TO RELATED APPLICATIONS

The present application claims the benefit of U.S. Provisional Patent Application 61/520,931, filed 17 Jun. 2011, which is incorporated by reference to the present application, as a whole.

The present invention relates to a novel and useful apparatus for mounting door jambs and window frames.

The mounting of windows and doors openings normally entails the creation of such opening followed by the installation of a jamb or frame. Typically, the opening for such door or window is formed without accurate plumbing or trueing. In addition, such jambs and frames do not directly attach to the supporting studs of the wall. In the case of fire resistant jambs and frames, metal studs have been used. However, such metal studs increase the need for shimming and reinforcing about the exterior of the jamb or frame. In any case, wood jambs and frames are the preferred material, since metal, aluminum, and plastic jambs and frames may be aesthetically unsatisfactory.

Further, fire rated openings for doors and windows requires that the plumb and square of the opening for such doors and windows be precise. In the prior shimmed jamb and frame systems, the creation of a fire resistance status necessitates placement of a seal between the jamb and studs formed of heat expanding graphite, silica, intumescent material, fiberglass, other non-flammable material. All such items reduce heat and fire penetration at the door or window opening.

In the past, once the jamb is placed within a door or window opening, gaps between the jamb and supporting studs or frame are typically filled with tappered shims to allow for adjustment. Such processes are painstaking and tedious. Following placement of the shims, nails are hammered through the jamb, shims, and stud within the rough opening of the frame to fix the jamb in place. Unfortunately, this process often disturbs the plumb of the jamb. Following the plumbing of the jamb, the shims are cut flush to the jamb and frame and a final casing or trim is applied around the periphery of the jamb to provide a finished appearance.

Prior art methods have been proposed to overcome the problems associated with the traditional door jamb and window frame placement. For example, L-brackets have been used to fit on the backside of a jamb via slots or through another bracket. Unfortunately, such systems create problems since it is difficult to line up such brackets and provide a tight fastening of the same. Also, further brackets are necessary to be placed at the position of the door hinges in order to support the weight of the door. Such additional provision tends to cause misalignment of the door, especially if the supporting stud is damaged or out of square at that particular area. Moreover, the size of the brackets require alterations of the casing in order to prevent a wavy outer appearance of the casing. In certain instances, oversized casings are required to cover such bracket legs when they are employed on the jamb.

In this regard, many structures have been proposed with the respect to the assemblage of doors and door jamb frames. For example, U.S. Pat. No. 7,882,662 describes a door hanger using a serious of clips between the door jamb and the door. The hanger includes an alignment flange perpendicular to a jamb arm to allow for properly mounting a door.

U.S. Pat. Nos. 2,582,468, 3,614,846, 6,253,507, 6,588,159, and 7,654,046 describes straps clips and sheaths for assembling a jamb frames for the mounting of doors.

U.S. Pat. Nos. 3,440,783, 4,014,146, 6,293,061, and 7,716,886 show clips and brackets which are employed to assemble jambs and hold the same to structural members, such as studs.

United States Patent Publication 2010/0115864 describes an adjustable frame assembly for fire rated opening that employs an adjustable bracket to vary the width and depth of the mounted members.

U.S. Pat. No. 5,347,780 and Unites States Patent Publication 2009/0241465 illustrates door frame structures that includes fire proof materials, such gypsum and fiberglass.

U.S. Pat. Nos. 7,487,592 and 7,921,603 describe fire resistant jamb frames using intumescent materials within the frame structure to affect fire proofing.

U.S. Pat. No. 4,281,481 shows a fire resistant aluminum door structure that includes expansion cavities to allow expansion of the header and jamb without buckling during a fire.

U.S. Pat. Nos. 5,210,986 and 5,722,207 teach nailing fins for window members to allow installation of windows in and edifice.

U.S. Pat. No. 3,457,686 shows a door and window frame construction that utilizes interlocking brackets to plum a jamb frame in multi directions.

An apparatus for easily installing door jambs and window frames would be a notable advance in the building arts.

SUMMARY OF THE INVENTION

The present invention concerns a novel apparatus for the installation of door jambs and window frames.

The apparatus of the present invention utilizes angled members, typically having at least a pair of wings or legs, which extend the full length and width of the jamb or frame. One wing or leg is fastened directly to the backside of the jamb while the other wing or leg extends outwardly from the jamb along or parallel to the wall of the edifice. Thus, a wing or leg forming a portion of the angled member attached to the back of the jamb is not visible on the face of the jamb after installation. Typically on a jamb, a pair of angled members are employed each extending to the edge of the back of the jamb. Also, the distance between such pair of angled members may be adjusted according to the size of the jamb and the type of jamb or frame being employed to mount a door or window, respectively. The full length angled member also adds rigidity to the jamb or frame providing tighter tolerances when such jamb or frame is held to the door or window opening, respectively. Also, the adjustment of the pair of angled members on the back side of the jamb or frame allows the installer to move the same inwardly from the surface of the wall to obviate the need to alter the casing covering the angled members around the jamb or frame. Fire rated jambs may be achieved by use of angled members with a stud, preferably a metal stud, found in the adjacent wall. In addition, in certain cases the angled members may be placed beneath the drywall of the edifice to eliminate the use of a casing, since filling compound may be employed to occupy the space up to the periphery of the jamb.

It may be apparent that a novel and useful apparatus for mounting doors and windows to jambs and frames, respectively has been hereinabove described.

It is therefore an object of the present invention to provide an apparatus for mounting doors and windows to jambs and frames which allows for the installation of jambs and frames having various designs.

Another object of the present invention is to provide an apparatus for mounting door jambs and window frames which is easily adapted for use with a broad range of wall thicknesses.

Another object of the present invention is to provide an apparatus which provides a fire rated door jamb that is particularly adapted for use with fire rated doors.

A further object of the present invention is to provide an apparatus for the mounting of door jambs and window frames which does not interfere with the installation or affect the esthetic of surrounding casings.

A further object of the present invention is to provide an apparatus for the installation of door jambs and window frames which eliminates fasteners extending through the face of the jamb or frame.

A further object of the present invention is to provide an apparatus for the installation of door jambs and window frames which eliminates the use of shims and eliminates additional material employed to achieve a fire rated status.

Yet another object of the present invention is to provide an apparatus for the installation of door jambs and window frames which eases the effort expended in plumbing or squaring the door jamb or window frame.

The invention possesses other objects and advantages especially as concerns particular characteristic and features thereof which will become apparent as the specification continues.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
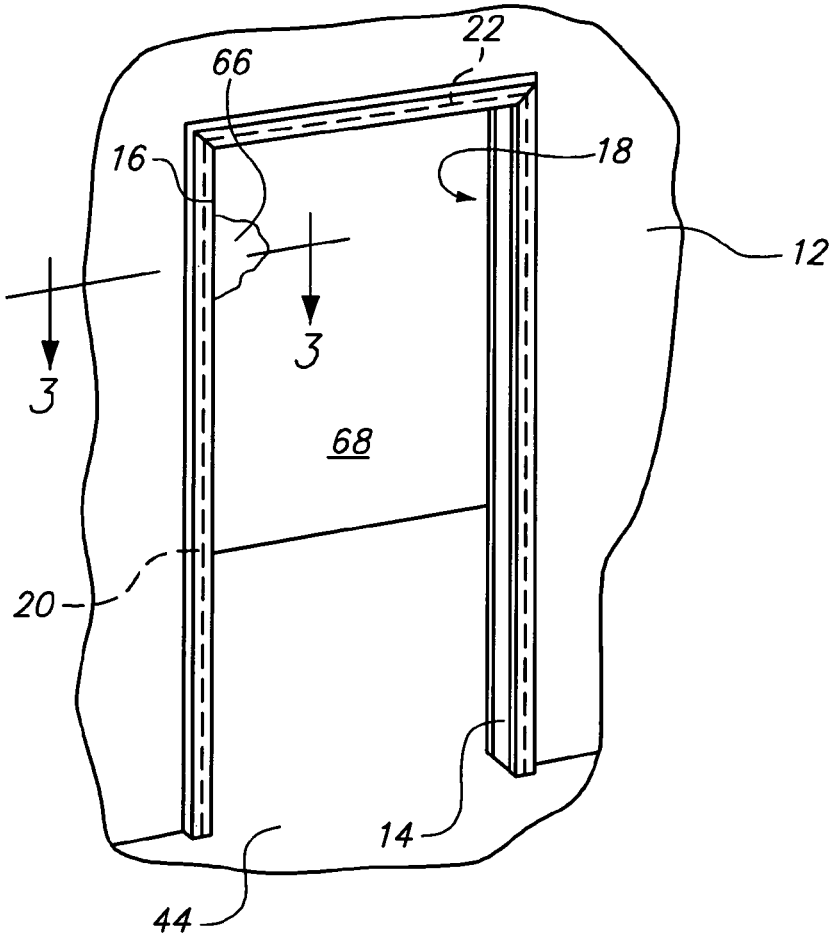
FIG. 1 is a top left perspective view of a door way having an encased door jamb utilizing the apparatus of the present invention, with a door partially illustrated.

An embodiment of the invention as a whole is depicted in the drawings by reference character 10. The apparatus 10 is employed to install door jambs and window frames in wall openings. For example, FIG. 1 shows a wall 12 having door jamb frame 18 installed therewith. Casing 16 provides an esthetic cover to the meeting point between jamb frame 18 and the studs (shown in FIGS. 3-6) within wall 12. Jamb frame 18 includes vertical legs or elongated elements 14 and 20, as well as elongated head or horizontal jamb leg element 22.

Figure 2:
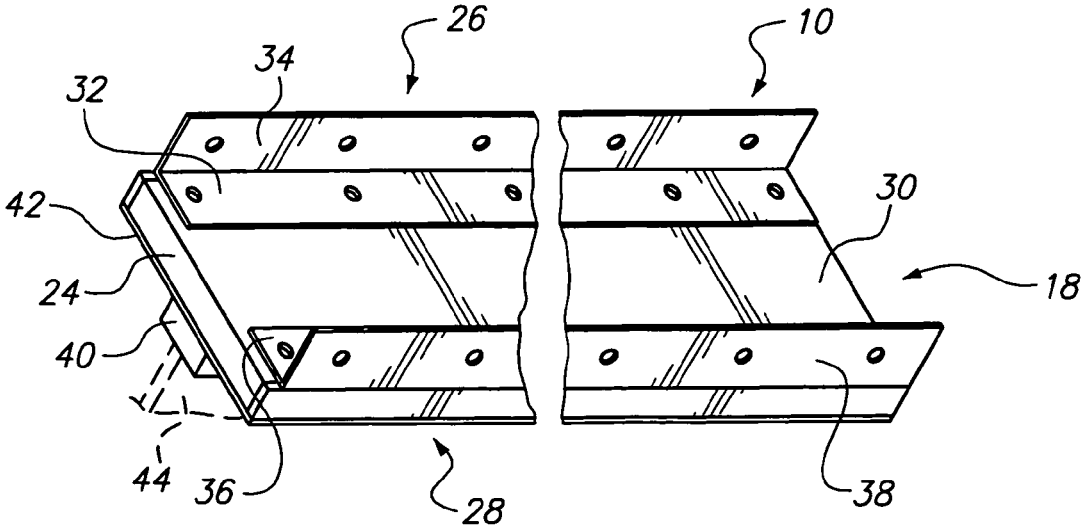
FIG. 2 is a top, left, perspective view of the apparatus of the present invention in place on a truncated portion of a door jamb with an optional window glass depicted in phantom.

Referring now to FIG. 2, it may be observed that a portion 24 of jamb frame 18 is depicted, as exemplar, of the structure of each vertical element 14 and 20 and head 22 of door jamb 18. Apparatus 10 includes a pair of continuous angled members 26 and 28 which are fastened to the rear surface 30 of exemplar truncated portion 24 of vertical leg 20 jamb frame 18 and extend substantially along the entire length of exemplar truncated portion 24. In certain cases, angled members 26 and 28 may be formed into multiple side-by-side pieces, with a minimal space between the same. As shown in FIG. 2, angled member 26 includes wings or legs 32 and 34 while angled member 28 includes wings or legs 36 and 38. Specifically, wings 32 and 34 are fastened to the back surface 30 of exemplar truncated jamb portion 24 by the use of screws, staples, nails, glue or any other fastening device which will be shown hereinafter. Exemplar truncated portion 24 of jamb frame 18 also includes a stop 40 on side 42 of exemplar truncated portion 24 that normally faces a door (not shown). In addition, a window glass 44 is depicted in phantom to denote that jamb truncated portion 24 may also form part of a window frame (phantom). In such a case, stops, similar to stop 40, would be positioned on either side of glass 44.

Figure 3:
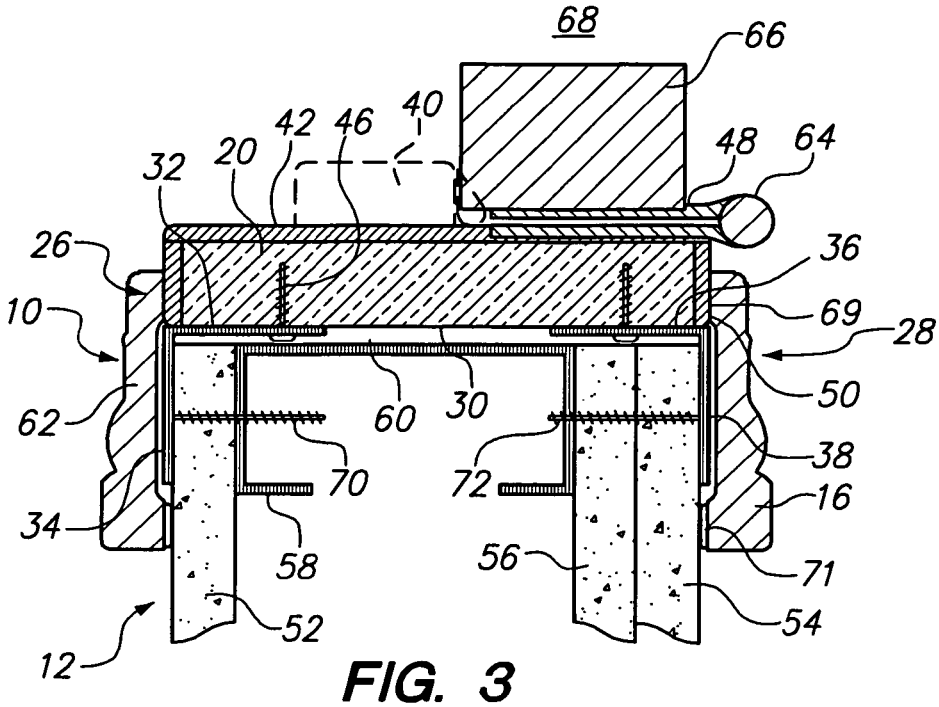
FIG. 3 is a sectional view taken along line 3-3 of FIG. 1.

With reference to FIG. 3, it may be seen that angled members 26 and 28 (solid line) are fastened to a standard vertical jamb leg 20 and extend substantially the entire length of jamb leg 20 between horizontal element 22 of jamb frame 18 and floor 44, FIG. 1. Of course, jambs of varying designs may be employed with apparatus 10, including single rabbet, double rabbet, split jambs, and the like. Wings 32 and 36 of angled members 26 and 28 respectively, are fastened to vertical leg 20 of jamb frame 18 via screws 46 and 48, respectively. It should be noted that jamb vertical leg 20 includes a veneer 50 which is not penetrated by screws 46 and 48 in apparatus 10. Wings 34 and 38 of angled members 26 and 28, respectively, extend along dry wall panels 52 and 54 of wall 12. Additional dry wall panel 56 lies adjacent to dry wall panel 54 in the embodiment shown in FIG. 3.

Exemplar metal stud 58 (solid line) of wall 12 lies next to back surface 30 of vertical jamb leg 20 and a gap 60 is formed therebetween. It should be realized that studs or wall frame members would also lie adjacent vertical jamb leg 14 and head 22. Wings 32 and 36 at least partially occupy gap 60. It should be seen that FIG. 3, illustrates a fire rated jamb, where an intumescent substance or other material of the prior art, normally found in gap 60, is absent and unnecessary to achieve such fire rated status. In other words, prior art jamb structures required such material within gap 60. Thus, vertical members 26 and 28 and metal stud 58 serve as a shield to vertical leg 20 of jamb 18 should fire be located within wall 12 or the room adjacent opening 68. Similar angled members to angled members 26 and 28 may be positioned with respect to jamb leg 14 and element 22. Casings 16 and 62 are placed over wings 34 and 38 of angled members 26 and 28, respectively for the sake of esthetics and are fixed by any suitable fastening method. Mastic beads 69 and 71 are depicted in FIG. 3 as exemplar fasteners with respect to exemplar casing 16. It should be noted that no alterations to casing 16 and 62 are necessary for such placement since angled members 26 and 28 maintain the rigidity of jamb frame 18. This rigid support allows for tighter tolerances of jamb frame 18, required in achieving a fire rated status. Hinge 64 (solid line) and door portion 66 lie in room opening 68 defined by jamb frame 18. Screws 70 and 72 pass through wings 34 and 38 of sufficient thinness, respectively, and engage metal stud 58. In the case of angled member 26, dry wall portion 52 intervenes wing 34 and metal stud 58. Additionally, dry wall portions 54 and 56 intervene wing 38, of angled member 26 and stud 58 in this structure.

Figure 4:
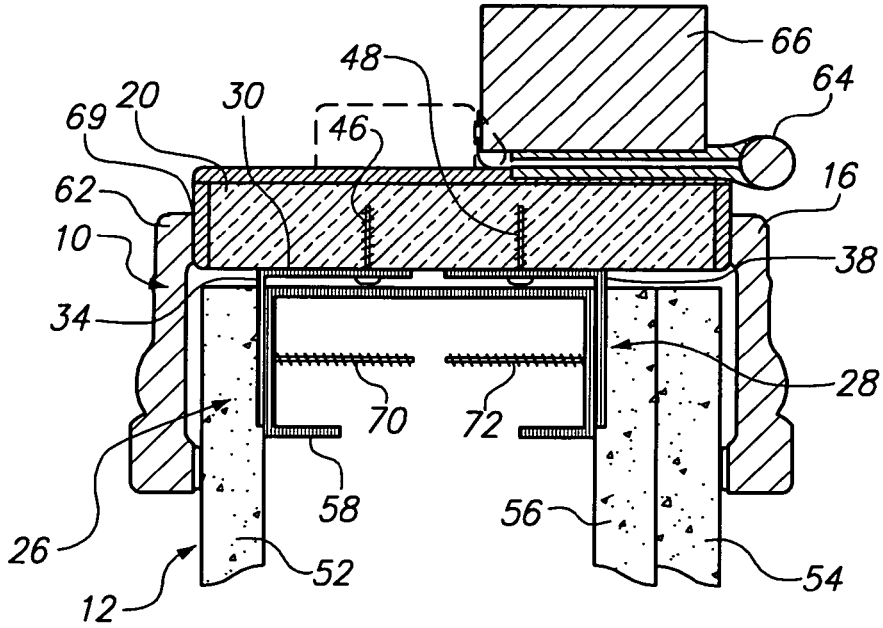
FIG. 4 is a sectional view similar to FIG. 3, showing an alternate use of the apparatus of the present invention.

Turning to FIG. 4, another use of apparatus 10 is depicted in which angled members 26 and 28 lie inside dry wall portions 52, 54, and 56 and against metal stud 58 of wall 12. Thus, angled members 26 and 28 are not visible from the exterior of dry wall portions 52 and 54. In this arrangement, casings 16 and 62 may be attached in an non-obstructed manner.

Figure 5:
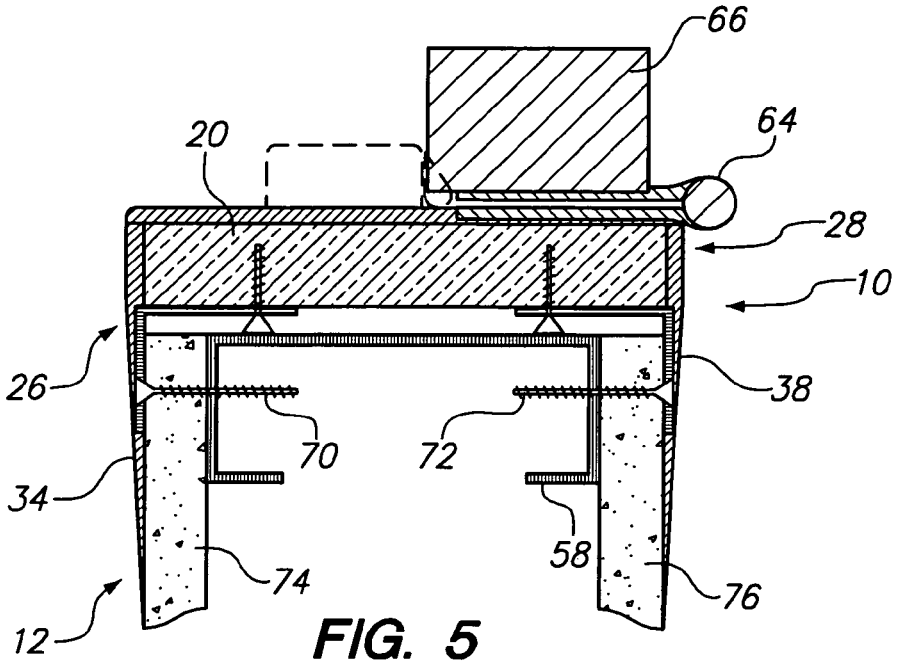
FIG. 5 is a sectional view similar to FIG. 3, showing another alternate use of apparatus of the present invention.

FIG. 5 illustrates another use of apparatus 10 in which angled member 26 and 28 lie outside of single dry wall items 74 and 76. Again screws 70 and 72 pass through wings 34 and 38 of angled member 26 and 28, respectively, and stud 58. Dry wall portions 74 and 76 of wall 12 interspace stud 58 and wings 34 and 38, respectively. It should be noted that wings 34 and 38 of angled members 26 and 28 are being employed as a dry wall corner bead, allowing for the finishing of dry wall portions 74 and 76 of wall 12 in a conventional manner without the use of a casing.

Figure 6:
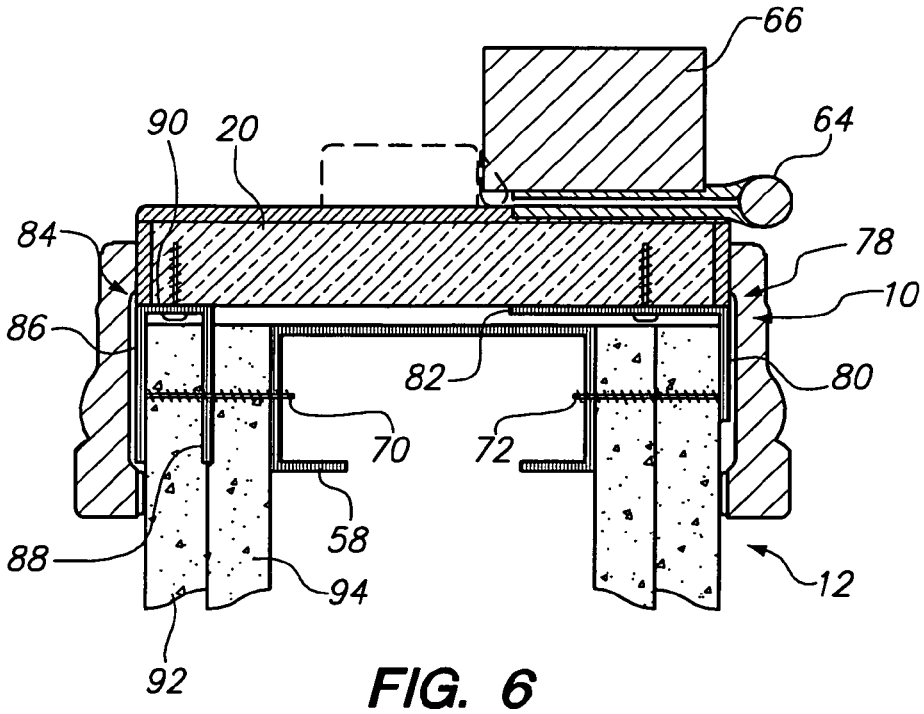
FIG. 6 is a sectional view similar to FIG. 3, showing yet another alternate use of the present invention For a better understanding of the invention reference is made to the following detailed description of the preferred embodiments of the invention which should be taken in conjunction with the above described drawings.

FIG. 6 depicts another configuration of apparatus 10 in which an angled member 78 (solid line) includes wings 80 and 82 having varying lengths. In addition, angled member (solid line) 84 takes the form of a U-channel having wings 86 and 88 extending from a base portion 90. Wing 88 lies between dry wall sections 92 and 94. It should be apparent that angled member 78 and angled member 84 extend substantially along the entire length of jamb leg 20 between horizontal element 22 of jamb frame 18 and floor 44.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A mounting apparatus for use with door jamb frames or window frames including an elongated element adjacent a wall, including a panel portion comprising:

a. a metal stud supporting the panel portion of the adjacent wall;

b. one angled member, said one angled member including a first wing and a second wing, said first wing of said one angled member extending substantially along the entire length of the elongated element, said second wing extending substantially along the entire length of the elongated element, said second wing extending substantially along the entire length of said metal stud;

c. a first fastener device for holding said first wing of said one angled member to the elongated element;

d. a second fastener device for holding said second wing directly to said metal stud without the panel portion of the wall lying between said metal stud and said second wing of said angled member, said first fastener extending between said first wing of said angled member and the elongated element without contacting said metal stud; and, wherein said one angled member held to the elongated element and said metal stud by said first and second fasteners, respectively, forms a gap between the elongated element said metal stud, said gap being free from said first fastener traversing said gap.

2. The mounting apparatus of claim 1 in which said one angled member comprises a metallic angled member and at least partially occupies said gap.

3. The mounting apparatus of claim 1 in which said one angled member extends substantially along the entire length of the elongated element of a door jamb frame.

4. The mounting apparatus of claim 1 in which said one angled member forms a corner bead of the adjacent wall.

5. The mounting apparatus of claim 1 in which said first wing includes a length dimension larger than a length dimension of said second wing.

6. The mounting apparatus of claim 1 in which additionally comprises:

a. another angled member, said another angled member including a first wing and a second wing, said another angled member extending substantially along the entire length of the elongated element apart from said one angled member, said second wing extending substantially along the entire length of said metal stud;

b. a third fastener device for holding said first wing of said another angled member to the elongated element; and c. a fourth fastener device for holding said second wing of said another angled member to said metal stud.

7. The mounting apparatus of claim 6 in which said another angled member held to the elongated element and said metal by stud said first and second fasteners, respectively, forms a gap between the elongated element and said metal stud.

8. The mounting apparatus of claim 6 in which said another angled member comprises a metallic angled member and at least partially occupies said gap.

9. The mounting apparatus of claim 6 in which said another angled member extends substantially along the entire length of the elongated element of a door jamb frame.

10. The mounting apparatus of claim 6 in which said another angled member extends substantially along the entire length of the elongated element of a window frame.

11. The mounting apparatus of claim 6 in which said another angled member forms a corner bead of the adjacent wall.

* * * * *